US005307234A

United States Patent [19]

Homolka

[11] Patent Number: 5,307,234

[45] Date of Patent: Apr. 26, 1994

[54] CORONA DISCHARGER WITH COUNTER ELECTRODE OF WIRE COATED BY CONDUCTIVE PLASTIC

[75] Inventor: Jürgen Homolka, Stuttgart, Fed. Rep. of Germany

[73] Assignee: Haug GmbH & Co. KG, Leinfelden-Echterdingen, Fed. Rep. of Germany

[21] Appl. No.: 704,775

[22] Filed: May 23, 1991

[30] Foreign Application Priority Data

May 26, 1990 [DE] Fed. Rep. of Germany ..... 4016997

[51] Int. Cl.[5] ..... H01T 19/00

[52] U.S. Cl. ..... 361/229; 361/231; 250/324

[58] Field of Search ..... 361/213, 229-231; 250/324-326

[56] References Cited

U.S. PATENT DOCUMENTS

| | | | |
|---|---|---|---|
| 3,619,719 | 11/1971 | Waller et al. | 361/229 |
| 3,812,399 | 5/1974 | Slocum, Jr. | 361/229 |
| 4,107,755 | 8/1978 | Kiefer | 361/220 |

*Primary Examiner*—A. D. Pellinen

*Assistant Examiner*—David Osborn

*Attorney, Agent, or Firm*—Shenier & O'Connor

[57] ABSTRACT

A bar-shaped device for generating electrical charges by corona discharges comprises a high voltage cable surrounded by an insulating casing, extending parallel to the longitudinal axis of the device and adapted to be connected to a high voltage source, a plurality of needle electrodes connected to high voltage via the high voltage cable and arranged in at least one row along the longitudinal axis of the device, an insulating member accommodating the high voltage cable and the needle electrodes and an outer sheath surrounding the insulating member and having a longitudinal slot, wherein the needle electrodes penetrate the longitudinal slot and the edges of the longitudinal slot form counterelectrodes for the needle electrodes. The outer sheath consists of plastic and has grooves at the edges of its longitudinal slot parallel to the row of needle electrodes. A metal stranded wire provided with a casing made of pliable plastic is inserted into each of these grooves as counterelectrode. The plastic forming the casing is electrically conductive and in electrically conductive communication with the metal stranded wire.

3 Claims, 2 Drawing Sheets

CORONA DISCHARGER WITH COUNTER ELECTRODE OF WIRE COATED BY CONDUCTIVE PLASTIC

The invention relates to a device for generating electrical charges according to the preamble to patent claim 1.

Devices of this type are known from U.S. Pat. No. 4,107,755 and U.S. Pat. No. 3,443,155. In the latter publication, the longitudinal slot of the sheath is, however, replaced by circular openings surrounding the needle electrodes. The outer sheath of the known devices consists of metal, for example an aluminum alloy. The edges of the longitudinal slot formed in the earthed sleeve, or the edge of the circular openings mentioned, act as direct counterelectrodes for the needle electrodes so that the customary corona discharges are formed therebetween and the desired electrical charges occur therein due to ionization.

The outer sheath produced from metal has the disadvantage that the device is relatively heavy, in particular when it is of considerable length, for example two or more meters. In addition, the sheath is, in cross section, a profiled tube and so production is relatively complicated and expensive. The aim has therefore been for a long time to replace this outer metal sheath by a sheath made of plastic. Since plastic is not naturally an electric conductor, the edges of the longitudinal slot formed in a plastic sheath can no longer be used as direct counterelectrodes.

The object of the invention is to design a generic device such that the edges of the longitudinal slot formed in this sheath act as counterelectrodes even when a non-metallic outer sheath is used.

The object is accomplished in accordance with the invention by the features of the characterizing clause of patent claim 1.

The advantage of this solution is to be seen in the fact that a relatively heavy outer sheath can be dispensed with and the entire device is therefore of a relatively light weight.

Features of preferred embodiments of the invention are the subject matter of patent claims 2 and 3.

GB-PS 1 407 718 also discloses the fact that an electric conductor can be inserted into an undercut groove.

Figure 1:
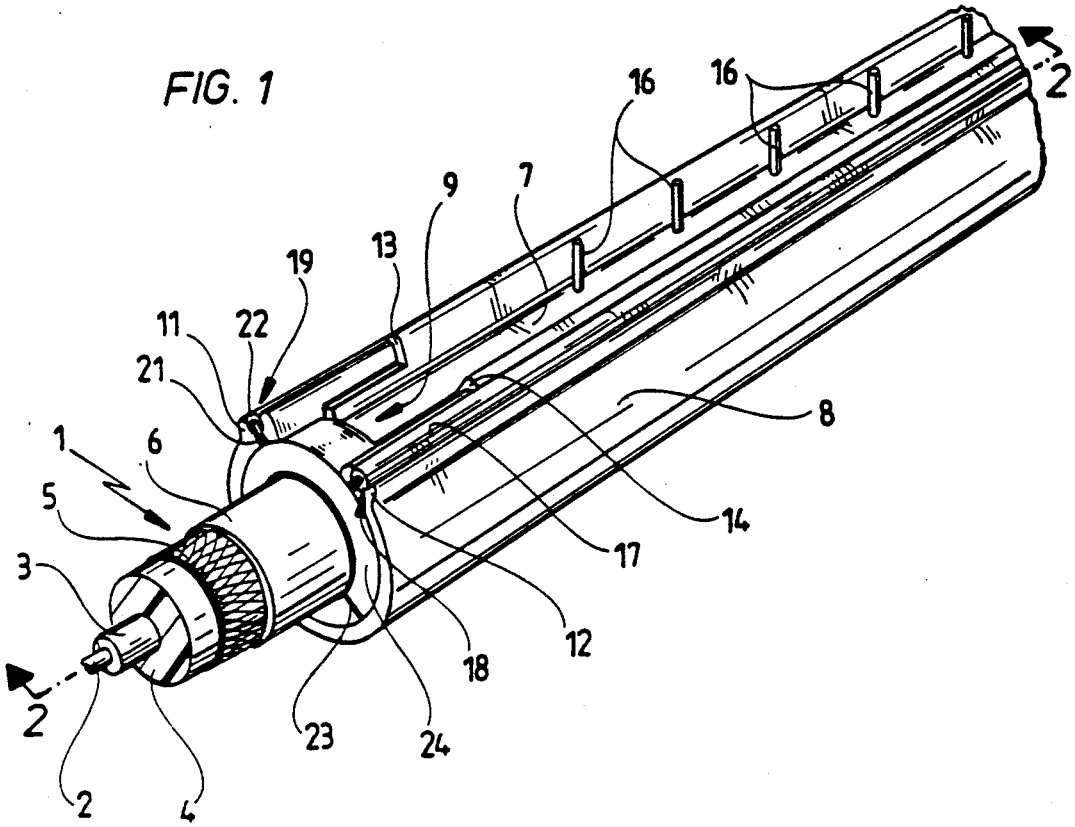
Figure 2:
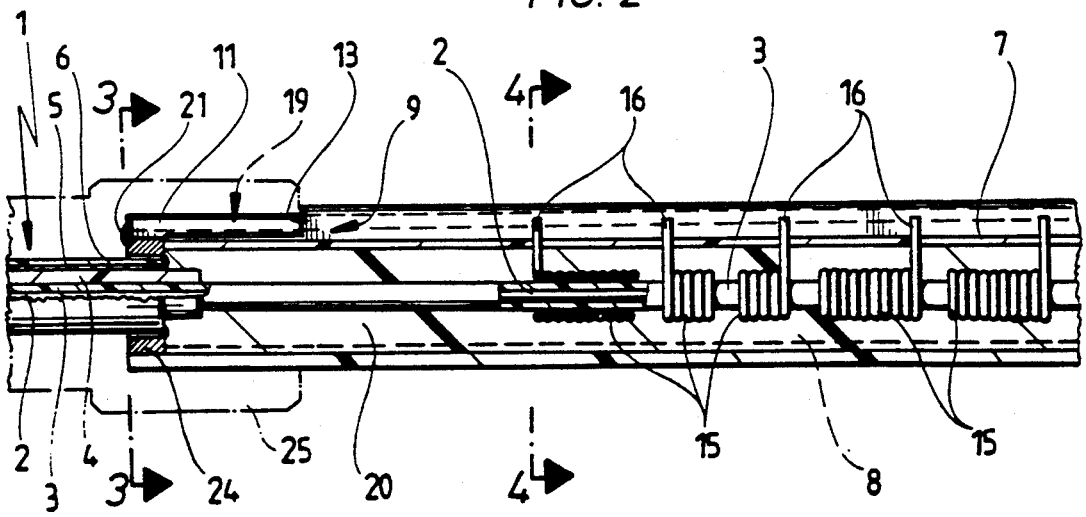
Figure 3:
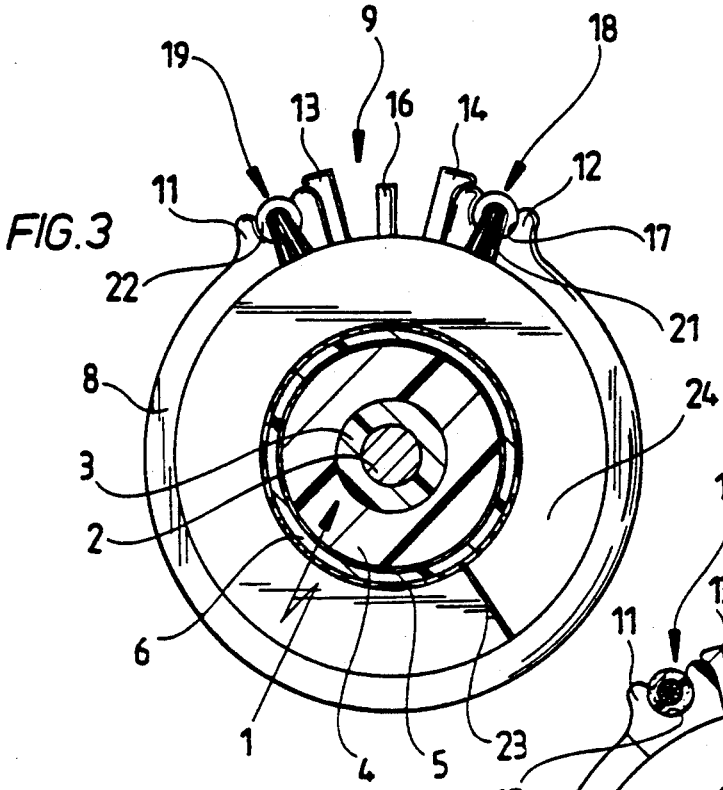
Figure 4:
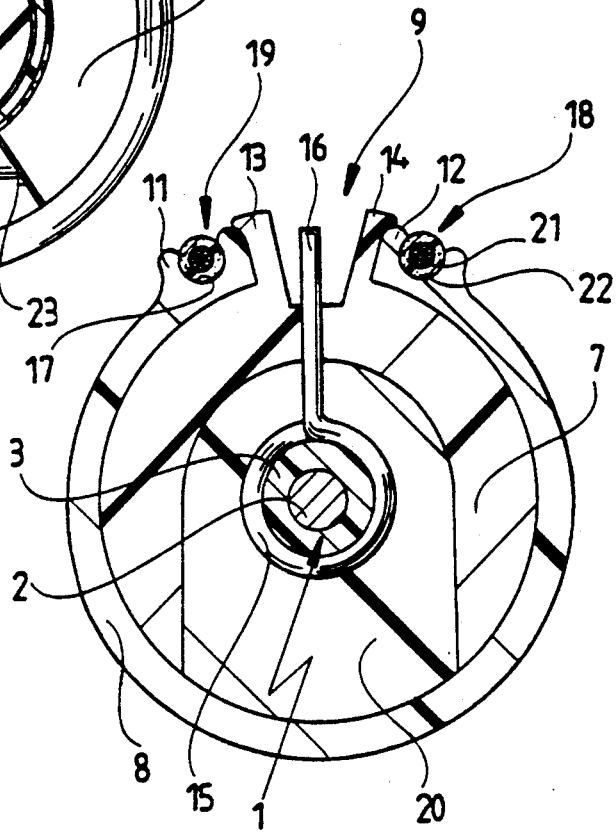
Figure 5:
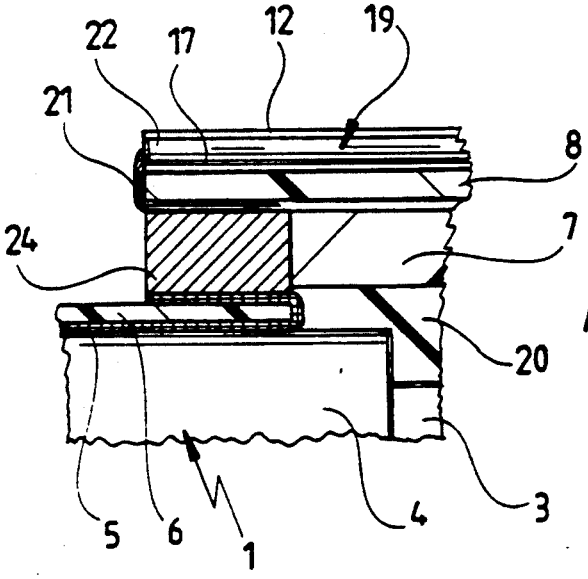

The following description of a preferred embodiment of the invention serves to explain the invention in greater detail in conjunction with the attached drawings, in which FIG. 1 is a perspective view of a bar-shaped device for generating electrical charges by corona discharge;

FIG. 2 is a sectional view along line 2—2 in FIG. 1;

FIGS. 3 and 4 are sectional views along lines 3 and 4, respectively, in FIG. 2 and FIG. 5 is a detailed sectional view in a sectional plane different to that in FIG. 2.

The device illustrated in the drawings for generating electrical charges is essentially bar-shaped in design and contains in its interior a high voltage cable which extends parallel to its longitudinal axis and has the following construction. A centrally located, inner metal strand 2, which can be connected to a high voltage source (for example, alternating current), is surrounded by a first, electrically insulating casing 3. The casing 3 is surrounded by a second, electrically insulating casing 4. The casing 4 is enveloped on its outer side by a protective metallic mesh 5 which is connectable to earth. The protective mesh 5 is followed by an additional insulating casing 6. At one end of the bar-shaped device, the high voltage cable 1 enters an insulating member 7 which is, for its part, surrounded by an outer sheath 8 made of plastic. The sheath 8 has a longitudinal slot with edges 11 and 12; this slot is parallel to the longitudinal axis of the device and is located at the top in FIG. 1. Protruding longitudinal edges 13, 14 of the insulating member 7 project into this longitudinal slot 9 and lie relatively close to the edges 11 and 12 of the outer sheath 8 (cf. also FIG. 4).

As best shown in FIG. 2, the casing 4, the protective mesh 5 and the additional casing 6 are removed from the inner casing 3 in the interior of the device, i.e. in the interior of the insulating member 7, so that the casing 3 extends freely through the insulating member 7. Helically wound wire coils 15 are slipped onto the casing 3 at regular intervals and one end of each coil is bent away at right angles to the longitudinal axis of the device to form a needle electrode 16. These needle electrodes penetrate corresponding holes in the upper side of the insulating member 7 which, as shown in FIG. 4, is open to the bottom so that the cable provided with the helical coils 15 can be inserted into the interior such that the needle electrodes each exit at the upper side and then lie in a row approximately in the center between the longitudinal edges 13, 14 of the insulating member 7 and between the edges 11, 12 of the longitudinal slot 9 of the outer sheath 8. Above the helical coils 15 the needle electrodes 16 are capacitively coupled to the strand 2 of the high voltage cable carrying the high voltage and are, therefore, also connected to high voltage.

As shown in FIG. 4, the insulating member 7 is filled with an electrically insulating casting resin 20 once the high voltage cable bearing the wire coils 15 with the needle electrodes 16 has been inserted into it. The insulating member 7 containing the high voltage cable and the needle electrodes is then inserted into the outer plastic sheath 8 from one end.

As shown in the drawings (in particular FIGS. 3 and 4), the outer sheath 8 produced from plastic has grooves 17 in the ends 11, 12 of the longitudinal slot 9 formed in it and these are therefore parallel to the row of needle electrodes 16. A flexible metal stranded wire 21 is placed in each of these grooves as counterelectrodes 18, 19 and these wires are surrounded by a casing 22 made of a pliable plastic or the like. As illustrated, the grooves 17 are designed to be undercut and have an open gap, the width of which is smaller than the outer diameter of the casing 22 so that the counterelectrodes 18, 19 can be captively clipped into the grooves 17.

The plastic forming the casing 22 of the metal stranded wires 21 is electrically conductive and is in direct electrically conductive communication with the metal stranded wire 21.

Polyethylene filled with carbon or polyvinyl chloride are, for example, suitable as electrically conductive plastics, whereby the carbon can be present in the form of carbon black or graphite. Plastics filled with electrically conductive metallic particles can also be considered.

The decisive factor is that the outer side of the casing 22 thereby acts as proper counterelectrode so that corona discharges can be formed in the known manner between the exposed needle electrodes 16 and this outer side.

The outer sheath 8 consisting of plastic is much lighter in weight than an outer sheath produced from metal. It is also cheaper to produce with the desired cross-sectional profile than a metal sheath. The cables described, consisting of the metal stranded wires 21 and the electrically conductive plastic casings 22, are flexible and easy to clip into the grooves 17, where they are reliably secured, at the edges 11 and 12 due to the pliable plastic casing.

The counterelectrodes 18 and 19 may also be contacted relatively easily, i.e. connected to earth, as will be described in the following: The plastic casing 22 is removed from the wire 21 at the end of the device, cf. FIG. 1, so that the wire lies exposed at this point over a certain length of, for example, about 1 cm. A ring 24 made of electrically conductive metal and preferably provided with a slot 23 is slipped onto the outer casing 6 of the high voltage cable 1. The outer diameter of this ring corresponds to the inner diameter of the outer sheath 8. When the high voltage cable 1, with the ring 24, is inserted into the end of the outer sheath 8, the ends of the exposed wires 21, which are correspondingly bent over, are securely clamped between the outer side of the ring 24 and the inner side of the sheath 8. This results in a direct electrical contact between the exposed wires 21 and the electrically conductive ring 24. This is best apparent from FIG. 5.

At the place where the ring 24 is slipped onto the outer casing 6 of the high voltage cable 1, the protective mesh 5 is folded back about this casing 6 in the manner shown in FIG. 5 so that it comes into direct electrical contact with the inner side of the ring 24. When the protective mesh 5 is consequently connected to earth, this connection will be transferred by the ring 24 directly to the wire 21 and, therefore, to the counterelectrodes 18, 19 which are then likewise earthed.

As shown in FIG. 2, the end of the bar-shaped device provided with the ring 24 can be covered by a connecting sleeve 25, e.g. of plastic, slipped onto the device.

The inventive device has been described in the aforesaid as "bar-shaped". The "bar" need not necessarily extend in a straight line. It may also be curved or closed to form a ring. This does not alter the fundamental construction of the device.

The present disclosure relates to the subject matter disclosed in German application No. P 40 16 997.9 of May 26, 1990, the entire specification of which is incorporated herein by reference.

I claim:

1. Device for generating electrical charges by corona discharge, comprising a high voltage cable surrounded by an insulating casing, said cable extending parallel to the longitudinal axis of the device and adapted to be connected to a high voltage source, also comprising a plurality of needle electrodes connected to high voltage via the high voltage cable and arranged in at least one row along the longitudinal axis of the device, an insulating member accommodating the high voltage cable and the needles and an outer sheath surrounding the insulating member and having a longitudinal slot, the needle electrodes penetrating the longitudinal slot and the edges of the longitudinal slot forming counterelectrodes for the needle electrodes, characterized in that the outer sheath (8) consists of plastic and has grooves (17) at the edges (11, 12) of its longitudinal slot (9) parallel to the row of needle electrodes (16), a metal stranded wire (21) provided with a casing (22) of plastic being inserted into each of the grooves as counterelectrode (18, 19), and that the plastic forming the casing (22) is electrically conductive and in electrically conductive communication with the metal stranded wire (21).

2. Device as defined in claim 1, characterized in that the groove (17) is designed to have an open gap of a width smaller than the diameter of the counterelectrode (18, 19) such that the latter is adapted to clip into the groove (17).

3. Device as defined in claim 1 in which said cable includes a grounded protective mesh (5), said device characterized in that each of said counterelectrodes (18, 19) comprises an exposed portion of said wire (21), that an electrically conductive ring (24) disposed over said high voltage cable within said outer sheath (8) at one end thereof and connected to said grounded protective mesh (5) firmly clamps said exposed portions of said wire between said conductive ring (24) and said sheath (8) in direct electrical contact with said sheath.

* * * * *